US007010252B2

(12) United States Patent
Nozawa

(10) Patent No.: US 7,010,252 B2
(45) Date of Patent: Mar. 7, 2006

(54) MOUNTING CONSTRUCTION OF A TONER CARTRIDGE FOR AN IMAGE FORMING APPARATUS

(75) Inventor: Ken Nozawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 46 days.

(21) Appl. No.: 10/718,046

(22) Filed: Nov. 20, 2003

(65) Prior Publication Data

US 2004/0105703 A1 Jun. 3, 2004

(30) Foreign Application Priority Data

Nov. 21, 2002 (JP) ..... 2002-338055

(51) Int. Cl.
*G03G 15/08* (2006.01)

(52) U.S. Cl. ..... 399/262

(58) Field of Classification Search ..... 399/119, 399/120, 258, 262, 263
See application file for complete search history.

(56) References Cited

U.S. PATENT DOCUMENTS

| | | | | |
|---|---|---|---|---|
| 5,722,019 A | | 2/1998 | Nakajima | |
| 5,809,384 A | * | 9/1998 | Johroku et al. | 399/262 |
| 6,091,919 A | * | 7/2000 | Nozawa et al. | 399/262 |
| 6,134,410 A | * | 10/2000 | Nakajima | 399/262 |
| 6,151,472 A | * | 11/2000 | Nakajima | 399/262 |
| 6,195,521 B1 | * | 2/2001 | Nozawa et al. | 399/262 |
| 6,363,233 B1 | * | 3/2002 | Nakajima | 399/120 |

FOREIGN PATENT DOCUMENTS

| | | |
|---|---|---|
| EP | 0913740 A2 | 5/1999 |
| JP | 06-102763 A | 4/1994 |
| JP | 09-190064 A | 7/1997 |
| JP | 11-109737 A | 4/1999 |
| JP | 11-133713 | 5/1999 |
| JP | 11-272053 A | 10/1999 |
| JP | 200-1075348 A | 3/2001 |

* cited by examiner

*Primary Examiner*—Sandra L. Brase
(74) *Attorney, Agent, or Firm*—Akin Gump Strauss Hauer & Feld, LLP

(57) ABSTRACT

A toner cartridge holds toner therein and is attached into an image forming apparatus. The toner cartridge has a mounting construction with a rotary member that is rotated about an axis to a position where the toner is discharged into the image forming apparatus. The mounting construction includes first and second engagement portions. The first engagement portion is formed on the rotary member, extending at an angle with the axis. The second engagement portion is formed on the image forming apparatus. When the toner cartridge is placed in the image forming apparatus, and is rotated in a first direction, the first engagement portion slides on the second engagement portion so that the toner cartridge is displaced in a second direction parallel to the axis.

7 Claims, 12 Drawing Sheets

MOUNTING CONSTRUCTION OF A TONER CARTRIDGE FOR AN IMAGE FORMING APPARATUS

BACKGROUND OF THE INVENTION

1. Field of the Invention

The present invention relates to a mounting construction of a toner cartridge and an image forming apparatus to which the toner cartridge is attached.

2. Description of the Related Art

Conventionally, a toner cartridge is a consumable item and is attached to an image forming apparatus. The toner cartridge has one longitudinal end to which a rotary knob is attached and the other longitudinal end to which a cap is attached. After attaching the toner cartridge to the image forming apparatus, the knob is rotated so that the toner cartridge is opened to discharge the toner therein into the image forming apparatus. The image forming apparatus has a receiving section that receives the toner cartridge therein. The receiving section has a positioning rib that engages the longitudinal end of the toner cartridge for fastening the end portion, and a guide rib that engages the rotary knob.

When the toner cartridge is attached into the image forming apparatus, the operator holds the toner cartridge in such a way that the toner cartridge is oriented with its cap side positioned lower than the knob side. Then, the lower end of the toner cartridge is first inserted into the receiving section and then the higher end is inserted into the receiving section. Upon insertion of the entire toner cartridge into the receiving section, the toner cartridge extends horizontal and the rotary knob engages the guide rib. When the rotary knob is rotated, the toner cartridge is opened while at the same time the toner cartridge is locked to the receiving section.

With the aforementioned conventional structure through which the toner cartridge is attached to the receiving section, the toner cartridge is tilted immediately before it is attached to the receiving section. Therefore, the toner in the toner cartridge tends to move toward one longitudinal end of the toner chamber. As a result, the toner is not supplied uniformly across the longitudinal direction of the toner cartridge. This uneven distribution of toner across the length of the toner cartridge can cause poor print quality. If the toner cartridge is held horizontal and forcibly inserted into the receiving section, the longitudinal end of the toner cartridge interferes with, for example, the positioning rib.

Furthermore, when the toner cartridge is detached from the receiving section, the rotary knob is rotated in the opposite direction to a direction in which the knob is rotated when the toner cartridge is attached. Then, the toner cartridge is lifted. At this moment, one longitudinal end of the toner cartridge is caught by the positioning rib, which in turn causes the toner cartridge to tilt. Therefore, the image forming apparatus may be tilted forcibly, causing the toner to spill all over the surroundings within the apparatus.

SUMMARY OF THE INVENTION

The present invention was made in view of the aforementioned drawbacks of the conventional image forming apparatus.

A toner cartridge holds toner therein and is attached into an image forming apparatus. The toner cartridge has a rotary member that is rotated about an axis to a position where the toner is discharged into the image forming. The toner cartridge includes a mounting construction with a first inclined surface and an engagement portion. The first inclined surface is formed on the rotary member and extends in a first plane at a first angle with the axis. The engagement portion is formed on the image forming apparatus and engages the first inclined surface when the toner cartridge is placed in the image-forming apparatus. When the rotary member is rotated in a first direction, the engagement portion slides on the first inclined surface so that the toner cartridge is displaced in a second direction parallel to the axis.

The first inclined surface is one of two first inclined surfaces that extend substantially in the first plane and are disposed substantially diametrically opposite to each other with respect to the axis.

The toner cartridge has a stepped portion and the image forming apparatus has a projection. When the toner cartridge is placed in the image forming apparatus, the projection engages the stepped portion.

The image forming apparatus further includes an urging member, e.g., a spring and a pressing member that urge the toner cartridge in a third direction opposite to the second direction.

The mounting construction further includes a projection and a second inclined surface. The projection is formed on the rotary member. The second inclined surface is formed on the image forming apparatus and extends in a second plane at a second angle with the axis. When the toner cartridge is placed in the image forming apparatus, the second inclined surface engages the projection. When the rotary member is rotated in a fourth direction opposite to the first direction, the projection slides on the second inclined surface so that the toner cartridge is displaced in a third direction opposite to the first direction.

A toner cartridge incorporates the aforementioned mounting construction.

An image forming apparatus includes a toner cartridge that has a rotary member and is attached to the image forming apparatus. The rotary member is rotated about an axis to a position where the toner is discharged into the image forming. The toner cartridge includes an inclined surface formed on the rotary member and an engagement portion. The inclined surface extends in a first plane at a first angle with the axis. The engagement portion is formed on the image forming apparatus. When the toner cartridge is placed in the image forming apparatus, the engagement portion engages the inclined surface. When the rotary member is rotated in a first direction, the engagement portion slides on the first inclined surface so that the toner cartridge is displaced in a second direction parallel to the axis.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described in detail with reference to the accompanying drawings.

First Embodiment

{Construction}

Figure 1:
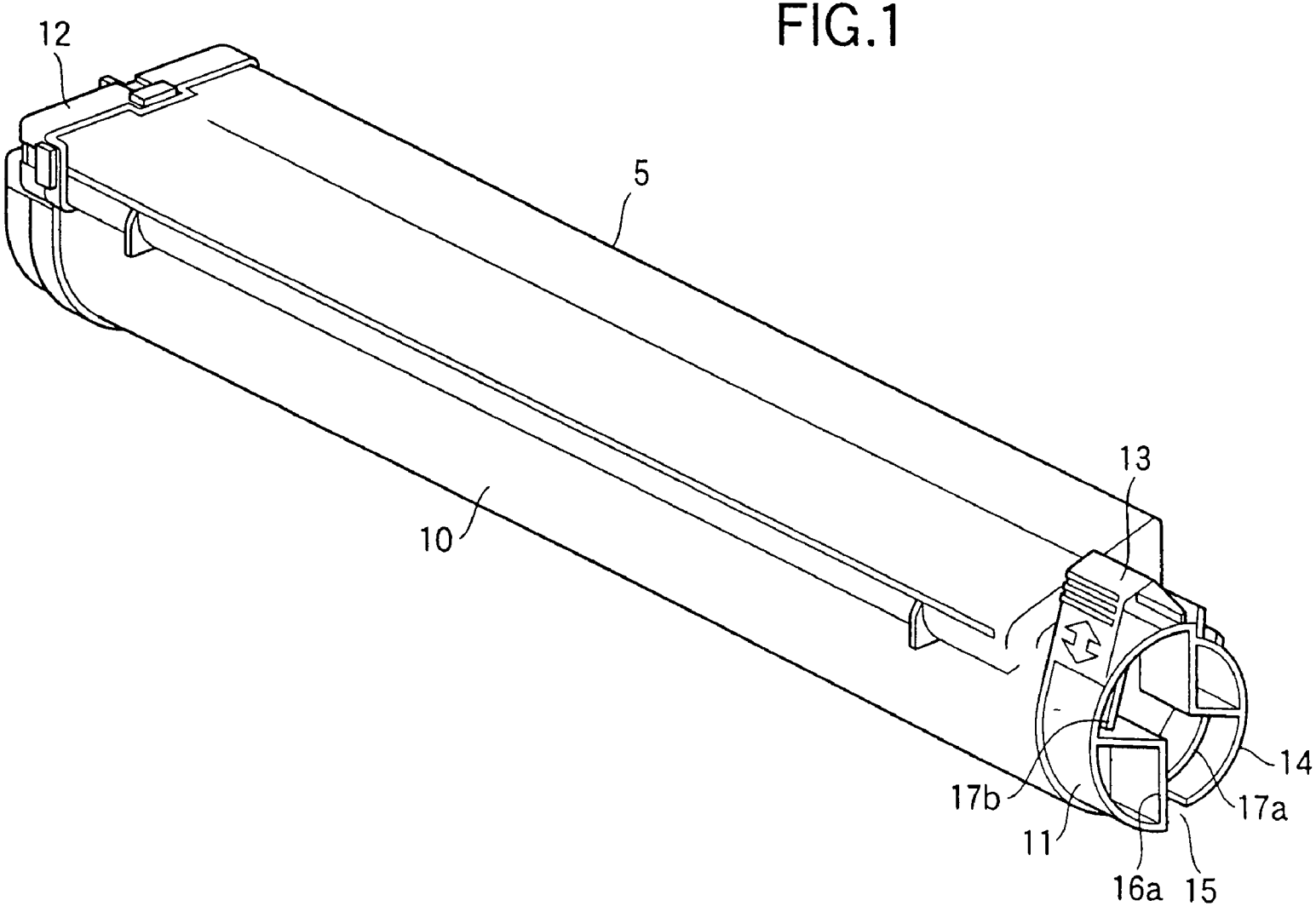
FIGS. 1 and 2 are perspective views illustrating a toner cartridge according to a first embodiment of the invention.
Figure 2:
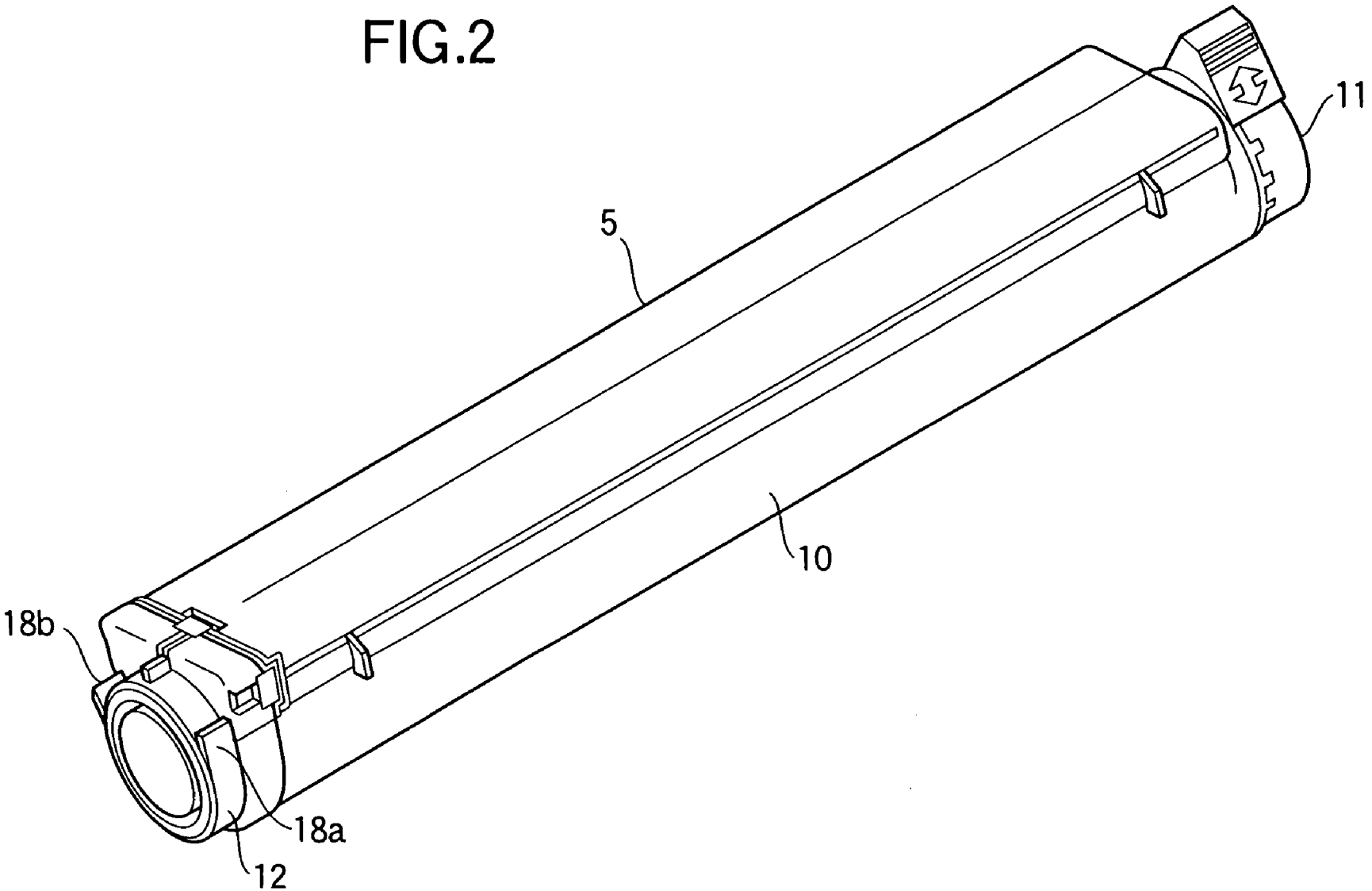

FIGS. 1 and 2 are perspective views illustrating a toner cartridge according to a first embodiment of the invention.

Figure 3:
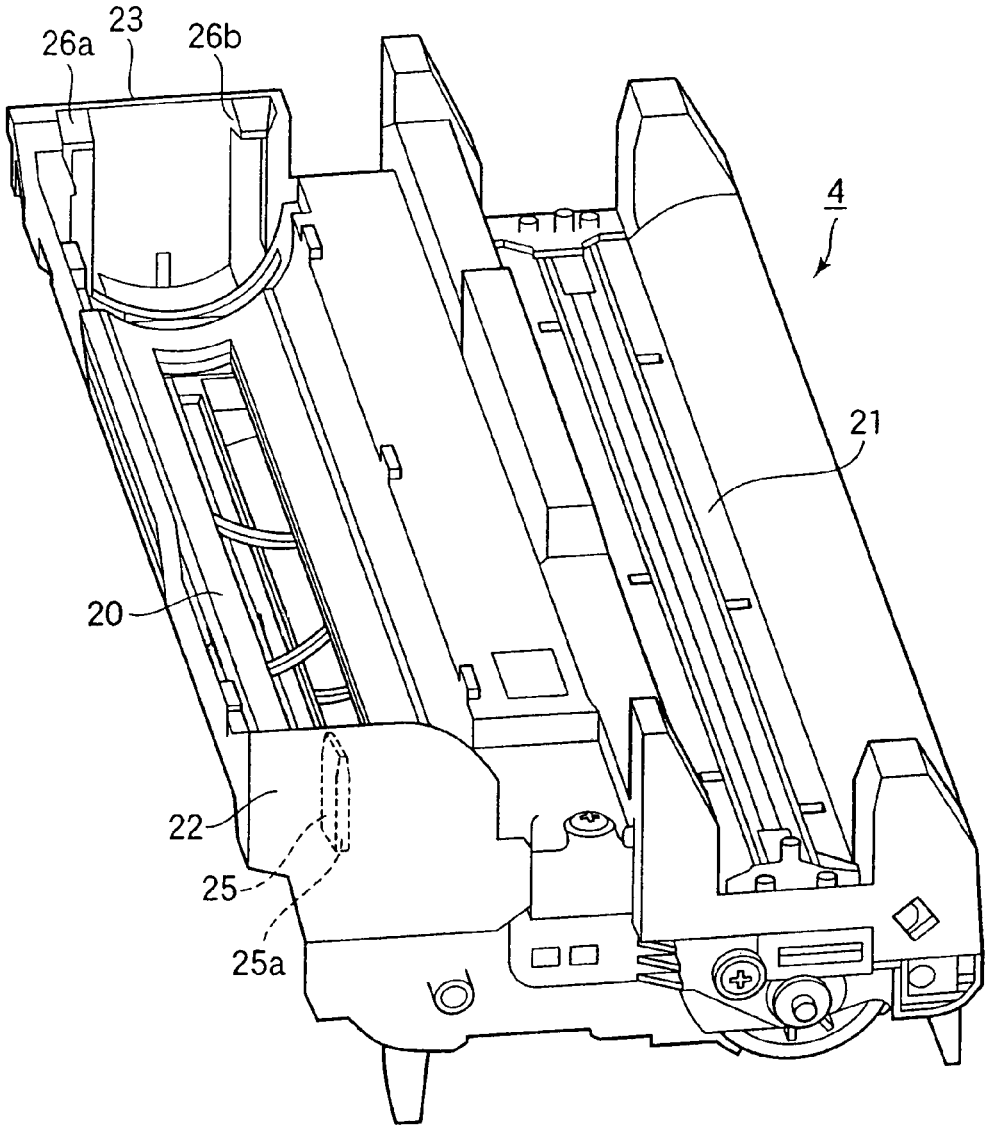
FIG. 3 is a perspective view illustrating a process cartridge according to the first embodiment.

FIG. 3 is a perspective view illustrating a process cartridge according to the first embodiment.

Figure 4:
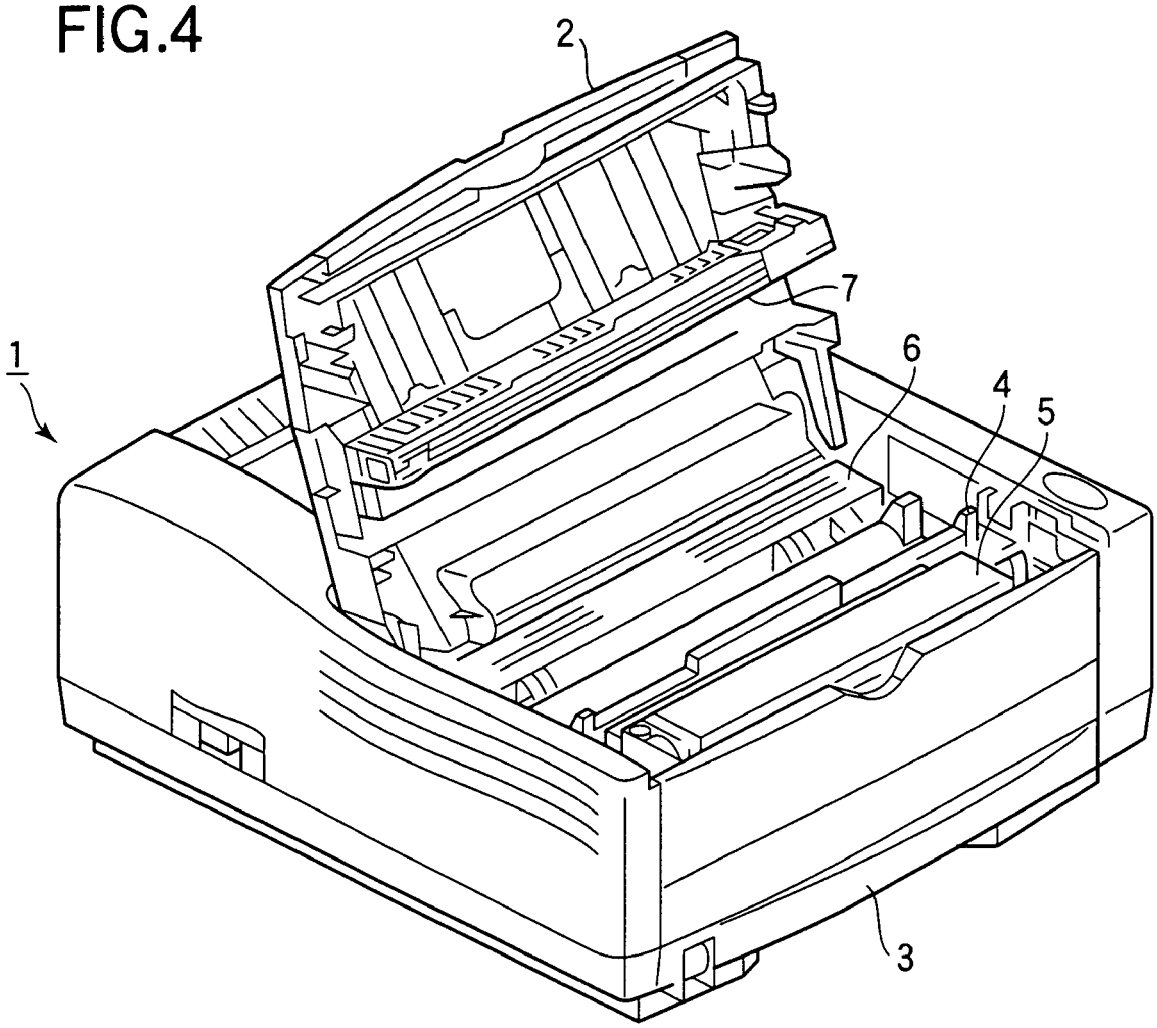
FIG. 4 is a perspective view of a printer to which the toner cartridge is attached.

FIG. 4 is a perspective view of a printer to which the toner cartridge is attached.

A printer 1 according to the invention will be described with reference to FIG. 4. FIG. 4 illustrates the printer 1 when a cover 2 is opened.

Referring to FIG. 4, the printer 1 is provided with a paper cassette 3 that holds a stack of print paper, a process cartridge 4, a toner cartridge 5, and a fixing unit 6. The toner cartridge 5 holds toner as a developer material and is attached to the process cartridge 4. The process cartridge 4 is detachably mounted to the printer 1. There is provided a print head 7 in the form of an LED head on the underside of the cover 2. The process cartridge 4, toner cartridge 5, fixing unit 6, and print head 7 constitute an image-forming section.

Referring to FIGS. 1 and 2, the toner cartridge 5 according to the first embodiment includes a generally cylindrical toner chamber 10, a rotary knob 11 rotatably attached to one longitudinal end of the toner cartridge 5, and a cap 12 attached to the other longitudinal end. The rotary knob 11 includes a lever 13 that the operator holds to operate, a substantially circumferential wall 14, a cut-out 15 formed in the circumferential wall 14, guide walls 16*a* and 16*b* on the inside of the circumferential wall 14, and arcuate walls 17*a* and 17*b*. The circumferential wall 14 is in the shape of a generally hollow cylinder. The arcuate walls 17*a* and 17*b* (FIG. 6) each have portions 27*a*, 27*b*, and 27*c* with different heights, and will be described later in detail. As shown in FIG. 2, the cap 12 is generally cylindrical and has projections 18*a* and 18*b* that project parallel in directions tangent to a circumferential surface of the cap 12.

Referring to FIG. 3, the process cartridge 4 is formed with a receiving section 20 into which the toner cartridge 5 is received, and another receiving section 21 in which a print head is received. The receiving section 20 has side walls 22 and 23 at opposing longitudinal ends and an opening formed in the bottom of the receiving section 20 through which the toner is discharged into a developing unit. A guide projection 25 is provided on an inner surface of the side wall 22 as shown in dotted lines. The guide projection 25 extends vertically. When the toner cartridge 5 is attached into the receiving section 20, the guide projection 25 enters a space defined on the inside of the circumferential wall 14 of the knob through the cut-out 15.

Projections 26*a* and 26*b* are formed on an upper portion of an inner surface of the side wall 23, being spaced apart by a predetermined distance. The projections 26*a* and 26*b* retain the toner cartridge properly when the toner cartridge 5 is attached into the receiving section 20. The lower portions of the projections 26*a* and 26*b* project toward the middle of the receiving section 20. When the toner cartridge 5 has been attached into the receiving section 20, the projections 26*a* and 26*b* are immediately over the projections 18*a* and 18*b* of the toner cartridge 5. The longitudinal distance between the tips of the projections 26*a* and 26*b* and the side wall 22 is slightly longer than the longitudinal outer dimension of the toner cartridge 5.

Figure 5:
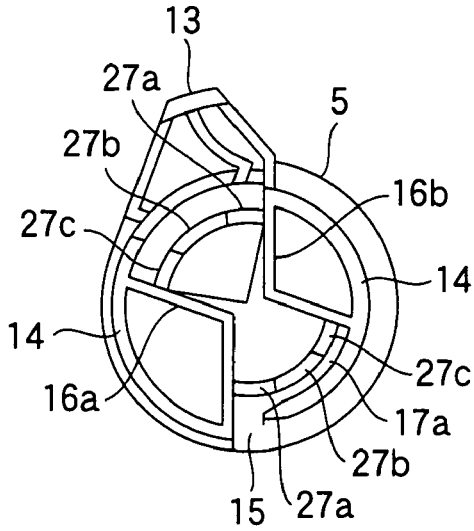
FIG. 5 is a side view of the toner cartridge illustrating a rotary knob.

FIG. 5 is a side view of the toner cartridge 5, illustrating the rotary knob 11.

Figure 6:
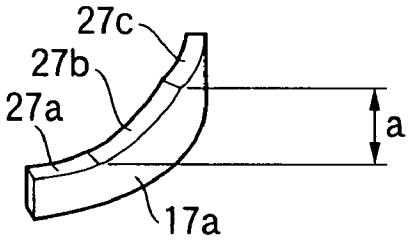
FIG. 6 is a perspective view of arcuate walls.

FIG. 6 is a perspective view of the arcuate wall 17*a*.

Referring to FIG. 5, the horizontal distance between the guide walls 16*a* and 16*b* is slightly longer than the width of the guide projection 25, so that the guide projection 25 can enter between the guide walls 16*a* and 16*b*. The arcuate walls 17*a* and 17*b* are formed between the guide walls 16*a* and 16*b*. As shown in FIG. 6 (only the arcuate wall 17*a* is shown), the arcuate wall 17*a* has three portions. The lowest portion 27*a* has a constant height. The portion 27*a* is a portion that first abuts the guide projection 25 when the toner cartridge 5 is attached into the receiving section 20.

The portion 27*b* is between the portions 27*a* and 27*c* and has the longest circumferential length of the three portions. The surface 27*b* extends in a plane at an angle with a longitudinal axis of the toner cartridge about which the rotary knob 11 is rotated. The portion 27*b* is higher nearer the portion 27*c* and is lower nearer the portion 27*a*. The inclination of the surface 27*b* is selected to be less than 45 degrees, so that when the rotary knob 11 is rotated, the surface 27*b* can slide smoothly on the guide projection 25. In the embodiment, the inclination is about 22 degrees. The portion 27*c* has a constant height. Another arcuate wall 17*b* also has three portions 27*a*, 27*b*, and 27*c*. The portion 27*a* of the arcuate wall 17*b* is also a portion that first abuts the guide projection 25 when the toner cartridge 5 is attached into the receiving section 20.

{Operation}

The operation for attaching the toner cartridge 5 according to the first embodiment into the receiving section 20 will be described.

Figure 7:
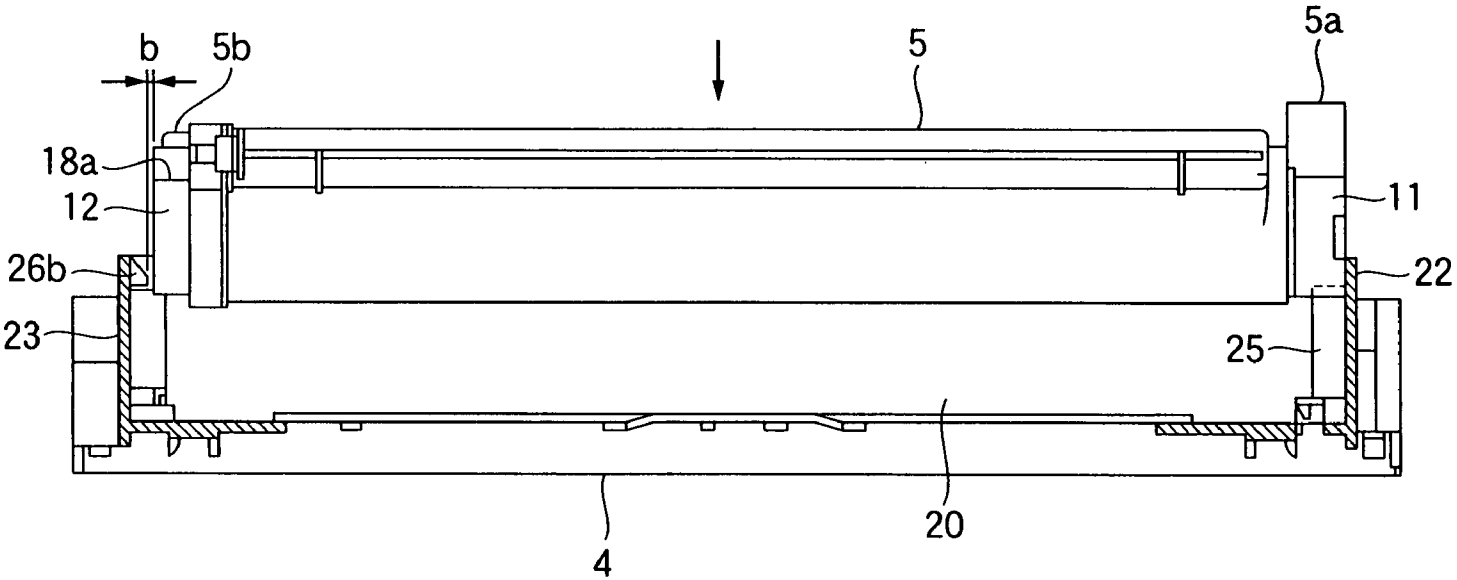
FIG. 7 illustrates the toner cartridge when it is partly inserted into the receiving section.

FIG. 7 illustrates the toner cartridge 5 when it is partly inserted into the receiving section 20.

Figure 8:
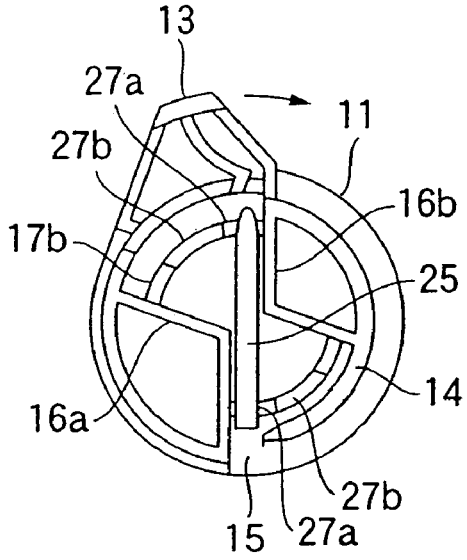
FIG. 8 is a side view illustrating the rotary member.

FIG. 8 is a side view illustrating the rotary member.

The longitudinal distance between the tips of the projections 26*a* and 26*b* and the side wall 22 is slightly longer than the longitudinal outer dimension of the toner cartridge 5. Therefore, the toner cartridge 5 can be attached into the receiving section 20 without having to tilt the toner cartridge 5.

Referring to FIG. 7, the toner cartridge 5 is attached to the receiving section 20 from above the receiving section 20. At this moment, the rotary knob 11 located at one end 5*a* of the toner cartridge 5 is at the lowest position. Therefore, as shown in FIG. 8, the guide projection 25 enters between the guide walls 16*a* and 16*b*, which are formed on the inside of the circumferential wall 14, through the opening 15 without interfering with the circumferential wall 14. At this moment, the guide rib 25 faces the lowest portion 27*a* of the inclined rib 17*a* and the lowest portion 27*a* of the inclined portion 17*b*. The other longitudinal end 5*b* of the toner cartridge 5 can enter the receiving section 20 without interfering with the projections 26*a* and 26*b*.

After the toner cartridge 5 has been placed in the receiving section 20, the rotary knob 11 is rotated. Rotating the rotary knob 11 clockwise as shown by an arrow in FIG. 8 causes a toner-discharging opening, not shown, to open and the portion 27*b* to move into contact with the guide projection 25. Further rotating the rotary knob 11 causes the toner cartridge 5 to move in the receiving section 20 to the projections 26*a* and 26*b*.

The distance a over which the toner cartridge 5 moves is determined by the length and the rate of change in the height of the portion 27*b*, i.e., the angle of inclination of the portions 27*b* of the arcuate wall 17*a* and 17*b*. In other words, the angle of inclination and length of the portion 27*b* is selected such that distance a is longer than a distance b over which the projections 18*a* and 18*b* move until they are under of the projection 26*a* and 26*b*.

Figure 9:
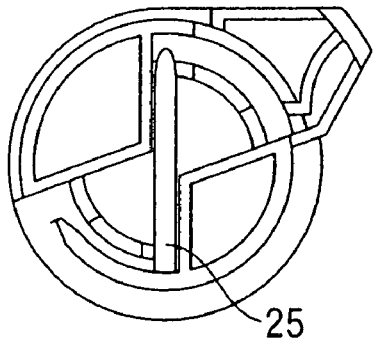
FIG. 9 is a side view illustrating the rotary member.

FIG. 9 is a side view illustrating the rotary member.

Figure 10:
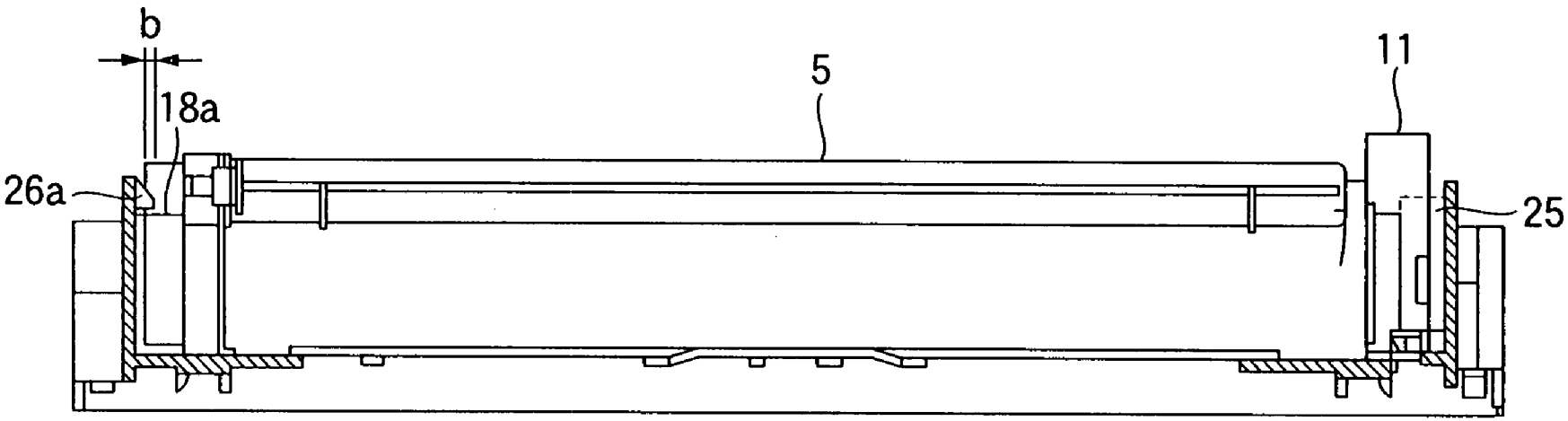
FIG. 10 is a side view of the toner cartridge according to the first embodiment.

FIG. 10 is a side view of the toner cartridge according to the first embodiment.

When the rotary knob 11 rotates to the position in FIG. 9, the projections 18*a* and 18*b* on the cap 12 of the toner cartridge 5 enter under the projections 26*a* and 26*b* as shown in FIG. 10. Thus, the other end 5*b* of the toner cartridge 5 is locked to the receiving section 20 so that the toner cartridge 5 cannot be taken out upwardly. When the guide projection 25 enters the space defined on the inside of the circumferential wall 14 of the rotary knob 11 as shown in FIG. 9, the end 5*a* of the toner cartridge 5 is locked to the receiving section 20.

When the toner cartridge 5 has been locked into the receiving section 20, the guide projection 25 opposes the portions 27*c* of the arcuate walls 17*a* and 17*b*. As described above, the portion 27*c* has not an inclined top but a constant height. For example, even if an external force is exerted on the toner cartridge 5 from the right side in FIG. 10, the toner cartridge 5 will not move in the same direction, the toner cartridge 5 remaining locked reliably.

The order in which the toner cartridge 5 is handled when the toner cartridge 5 is detached from the receiving section 20 is reversed with respect to that when the toner cartridge 5 is attached into the receiving section 20. In other words, the rotary knob 11 is rotated counterclockwise from the position in FIG. 9 where the toner cartridge 5 is locked, so that the rotary knob 11 can be lifted upward from the receiving section 20 and the toner cartridge 5 can move rightward in FIG. 10. Thus, the toner cartridge 5 can be taken out of the receiving section 20.

According to the first embodiment, the toner cartridge 5 is dimensioned such that the toner cartridge 5 can be lowered horizontally into the receiving section 20. The knob 11 has the arcuate walls 17*a* and 17*b* that abut the guide projection 25 when the cartridge 5 has been lowered into the receiving section 20. The arcuate ribs 17*a* and 17*b* enable the toner cartridge 5 to be received into the receiving section 20, the toner cartridge 5 being not tilted but held horizontal. Therefore, the toner inside the toner cartridge 5 will not pile up at one end of the toner chamber 10, thereby preventing degradation of print quality due to insufficient supply of toner. This prevents damage to the parts of the toner cartridge 5 if the toner cartridge 5 is attached to the receiving section 20 through a complicated procedure.

In the first embodiment, the arcuate walls 17*a* and 17*b* are provided on the inside of the circumferential wall 14 of the rotary knob 11, the arcuate walls 17*a* and 17*b* abutting the guide projection 25 to move the toner cartridge 5. The structure of the first embodiment is only exemplary. For example, the circumferential wall 14 of the rotary knob 11 may have a varying height and the receiving section 20 may be formed with a portion that abuts the top of the circumferential wall when the toner cartridge 5 is attached into the receiving section 20. This alternative structure also enables the toner cartridge 5 to move in its longitudinal direction after the toner cartridge 5 is placed in the receiving section 20.

Second Embodiment

A second embodiment differs from the first embodiment in that one end of a toner cartridge will not raise when the toner cartridge is attached into the receiving section 20.

Figure 11:
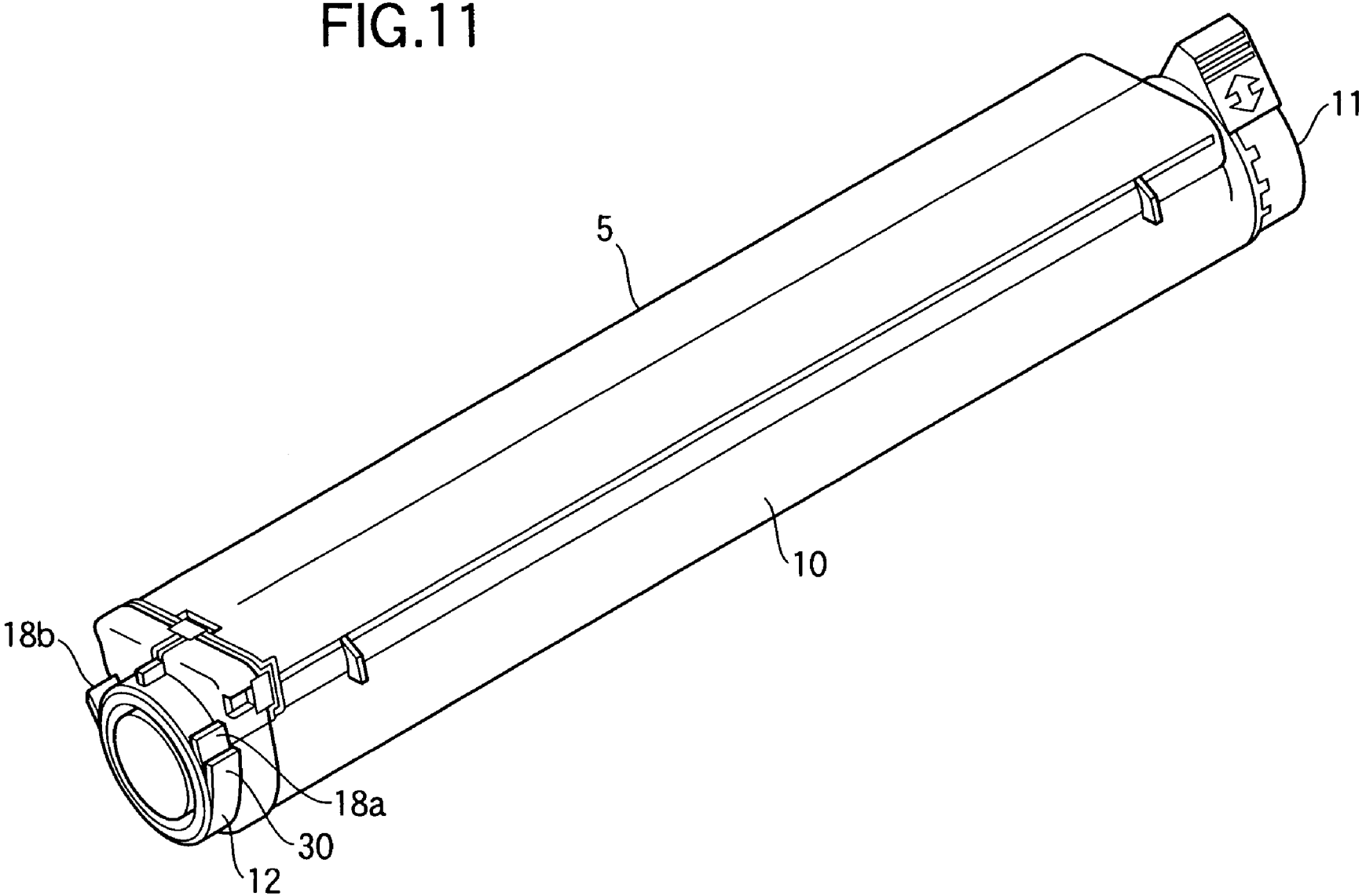
FIG. 11 is a perspective view illustrating a toner cartridge according to a second embodiment.

FIG. 11 is a perspective view illustrating a toner cartridge according to the second embodiment.

Figure 12:
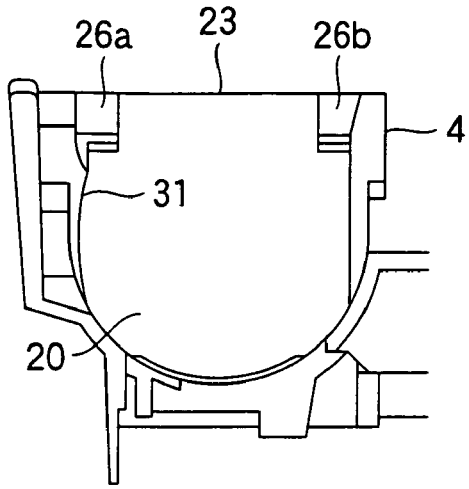
FIG. 12 is a side view illustrating a receiving section according to the second embodiment.

FIG. 12 is a side view illustrating a receiving section 20 according to the second embodiment.

Referring to FIG. 11, the cap 12 of the toner cartridge 5 according to the second embodiment has a stepped portion 30. The stepped portion 30 is formed in such a way that the cap 12 has a thickest circumferential wall. The stepped portion 30 has a flat top.

Referring to FIG. 12, a projection 31 is formed on a side wall 23 of the process cartridge 4 that opposes the circumferential surface of the cap 12 when the toner cartridge 5 is attached to the receiving section 20. When the toner cartridge 5 is attached into the receiving section 20, the projection 31 contacts the stepped portion 30 of the cap 12. The rest of the structure is substantially the same as the first embodiment.

The operation for attaching the toner cartridge 5 according to the second embodiment will be described with reference to FIGS. 13 and 14.

Figure 13:
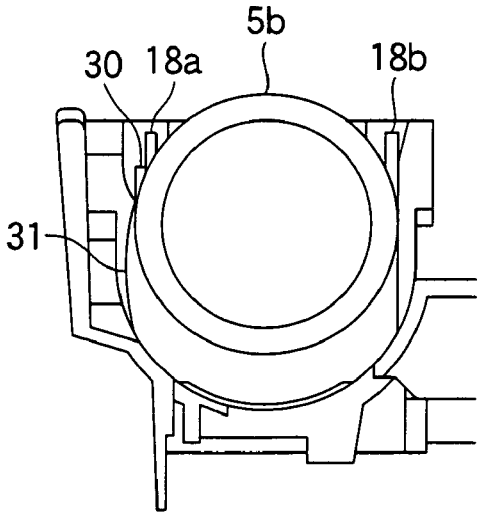
FIG. 13 is a side view of the receiving section when the toner cartridge is partly placed in the receiving section of FIG. 12.
Figure 14:
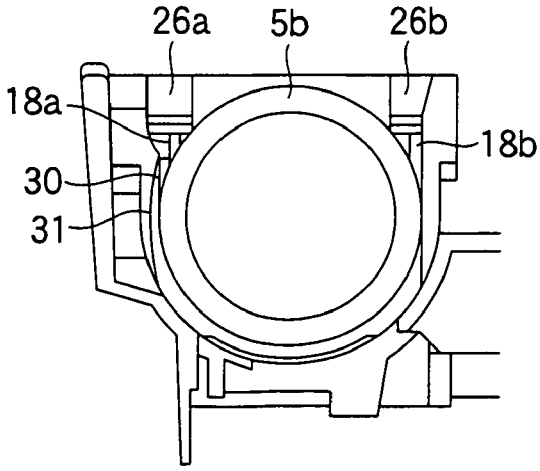
FIG. 14 is a side view of the receiving section when the toner cartridge is placed in the receiving section of FIG. 12.

FIGS. 13 and 14 are side views illustrating the operation for attaching the toner cartridge 5 into the receiving section 20.

The operation will be mainly described with respect to the attachment of one end of the toner cartridge 5 into the receiving section 20.

Just as in the first embodiment, the toner cartridge 5 is inserted into the process cartridge 4 without the toner cartridge 5 tilted but held horizontal. When the end portion 5*b* of the toner cartridge 5 is inserted into the receiving section 20, the stepped portion 30 formed on the cap 12 is brought into pressure contact with the projection 31 formed on the receiving section 20 as shown in FIG. 13. When the toner cartridge 5 is further pushed forcibly into the receiving section 20, both the receiving section 20 and the toner cartridge deform slightly so that the stepped portion 30 overcomes the projection 31. This allows the toner cartridge 5 to be completely attached to the receiving section 20 as shown in FIG. 14. When the projection 31 overcomes stepped portion 30, the toner cartridge 5 moves out of a pressed condition so that the operator feels "click motion" and therefore can be sure that the attachment of the toner cartridge 5 is completed.

With the toner cartridge 5 is received in the receiving section 20 as shown in FIG. 14, the stepped portion 30 has overcome the projection 31 and therefore the toner cartridge 5 is no longer press-fitted to the receiving section 20. Thus, the toner cartridge 5 is movable in its longitudinal direction. In this situation, if the toner cartridge 5 is raised, the stepped portion 30 interferes with the projection 31 so that the toner cartridge 5 cannot be raised with a small force. However, the toner cartridge 5 can be raised with a large force, and taken out of the receiving section 20.

As described above, the second embodiment has the stepped portion 30 and projection 31 that are pressed against each other when the toner cartridge 5 is attached into the receiving section. In the first embodiment, after the toner cartridge 5 has been placed in the receiving section 20, the rotary knob 11 is rotated. At this moment, an external force acts only on the end 5*a* of the toner cartridge 5 from above, so that the another end 5*b* may be raised. The second embodiment prevents the end 5*b* from raising, thus allowing the operator to handle the rotary knob 11 with one hand. This makes it easy to handle the toner cartridge 5. The stepped portion 30 and projection 31 may be preferably formed on the both ends of the toner cartridge 5.

Third Embodiment

Figure 15:
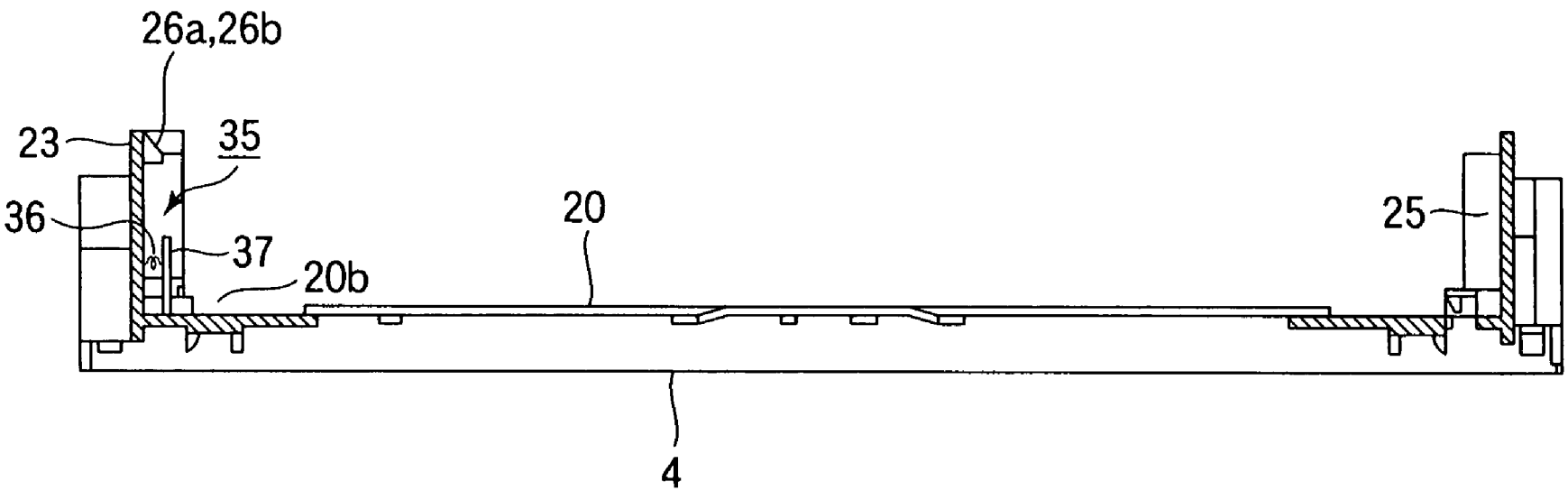
FIG. 15 is a front view of a pertinent portion according to a third embodiment.

FIG. 15 is a front view illustrating a pertinent portion of a third embodiment.

The third embodiment is featured in that when the toner cartridge 5 is taken out of the process cartridge 4, an urging member 35 causes the toner cartridge 5 to move in a direction opposite to that when the toner cartridge is attached.

Referring to FIG. 15, an urging member 35 is provided at a longitudinal end portion 20*b* of the receiving sections 20 of the process cartridge 4. The urging member 35 includes a compression spring 36 mounted to the side wall 23 and a pressing member 37 mounted to one end of the compression spring 36. The pressing member 37 is movable leftward and rightward (in a longitudinal direction of the toner cartridge) in FIG. 15. The urging member 15 is closer to the end (on the left side in FIG. 15) than the location at which the toner cartridge 5 is inserted. Thus, the urging member 35 cannot be an obstacle to the attachment of the toner cartridge 5 into the receiving section 20. The rest of the configuration is the same as the first embodiment.

As described in the first embodiment, the rotary knob 11 is rotated after placing the toner cartridge 5 into the receiving section 20, so that the toner cartridge 5 moves leftward in FIG. 15. At this moment, the urging member 35 is pushed by the toner cartridge 5 against the left side wall 23. While the toner cartridge 5 remains attached in the receiving section 20, the toner cartridge 5 remains in this situation so that the urging member 35 transmits the urging force rightward in FIG. 15 to the toner cartridge 5.

When the toner cartridge 5 is detached from the receiving section 20, the rotary knob 11 is rotated to a position where the toner cartridge 5 is unlocked, so that the toner cartridge 5 can be taken out of the receiving section 20. In other words, the toner cartridge 5 becomes movable rightward in FIG. 15 and the urging force of the urging member 35 causes the toner cartridge 5 to move rightward. Thus, the end portion 5*b* of the toner cartridge 5 moves to a location where the end portion 5*b* does not interfere with the projections 26*a* and 26*b*. Thus, the toner cartridge 5 can be taken out upward.

In addition to the advantages of the first embodiment, the third embodiment provides the following advantages. When the toner cartridge 5 is detached from the receiving section 20, rotating the rotary knob 11 allows the urging member 35 to leave from under the projections 26*a* and 26*b*, so that the toner cartridge 5 is moved to its initial position in the receiving section 20. Thus, the toner cartridge 5 can be taken out without the toner cartridge 5 interfering with the projections 26*a* and 26*b*. This prevents the toner in the process cartridge 4 from spilling all over the surroundings. The urging member for moving the toner cartridge may be, for example, a flat spring.

Fourth Embodiment

The fourth embodiment has the same feature as the third embodiment that when the toner cartridge 5 is taken out of the process cartridge 4, the toner cartridge 5 is moved in a direction opposite to that in which the toner cartridge 5 is attached into the process cartridge 4.

Figure 16:
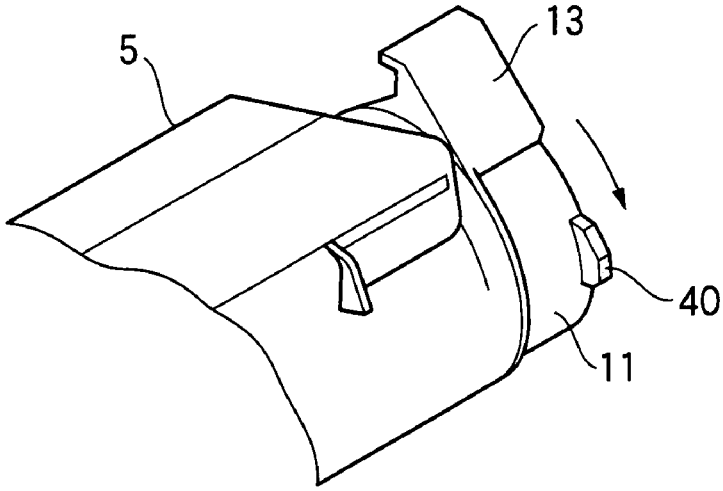
FIG. 16 is a fragmentary perspective view illustrating a pertinent portion of the toner cartridge according to a fourth embodiment.

FIG. 16 is a fragmentary perspective view illustrating a pertinent portion of the toner cartridge 5.

Figure 17:
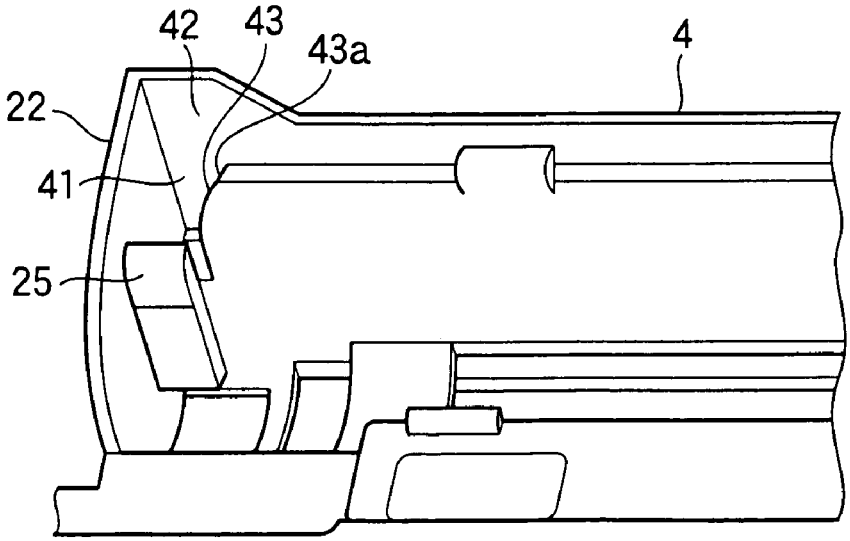
FIG. 17 is a fragmentary perspective view illustrating a pertinent portion of the process cartridge.

FIG. 17 is a fragmentary perspective view illustrating a pertinent portion of the process cartridge 4.

Referring to FIG. 16, a rotary knob 11 of the toner cartridge 5 according to the fourth embodiment has a projection 40 formed on a circumferential surface of the rotary knob 11. Referring to FIG. 17, the process cartridge 4 has a groove 41 near the side wall 22 of the process cartridge 4, the groove 41 receiving the projection 40 therein. The groove 41 is defined by a circumferential wall 42, the side wall 22, and an inclined surface 43 formed on the inner surface of the circumferential wall 42. The inclined surface 43 extends in a plane at an angle with the longitudinal axis of the toner cartridge 5 about which the rotary knob 11 is rotated. The inclination of the inclined surface 43 is less than 45 degrees with respect to the side wall 22 and is selected to be 22 degrees in this embodiment.

When the toner cartridge 5 is attached into the receiving section 20, the projection 40 enters the groove 41 and sits at a lower end of the groove 41. Then, when the rotary knob 11 is rotated to lock the toner cartridge to the receiving section 20, the projection 40 moves to an upper end of the groove 41. At the same time, the toner cartridge 4 moves rightward in FIG. 17 so that the projection 40 contacts or almost contacts an upper portion 43*a* of the inclined surface 43.

When the toner cartridge 5 is detached from the receiving section 20, the rotary knob 11 is rotated in the opposite direction. At the same time, the projection 40 moves downward while being in contact with the inclined surface 43, so that the entire toner cartridge 5 moves leftward in FIG. 17. The distance c is a distance over which the toner cartridge 5 moves from when the knob 11 begins to rotate until it stops. The distance b is a distance over which the toner cartridge 5 moves until the cartridge leaves from under the projections 26*a* and 26*b*. The angle of inclination and length of the inclined surface 43 are selected such that the distance c is longer than the distance b.

Figure 18:
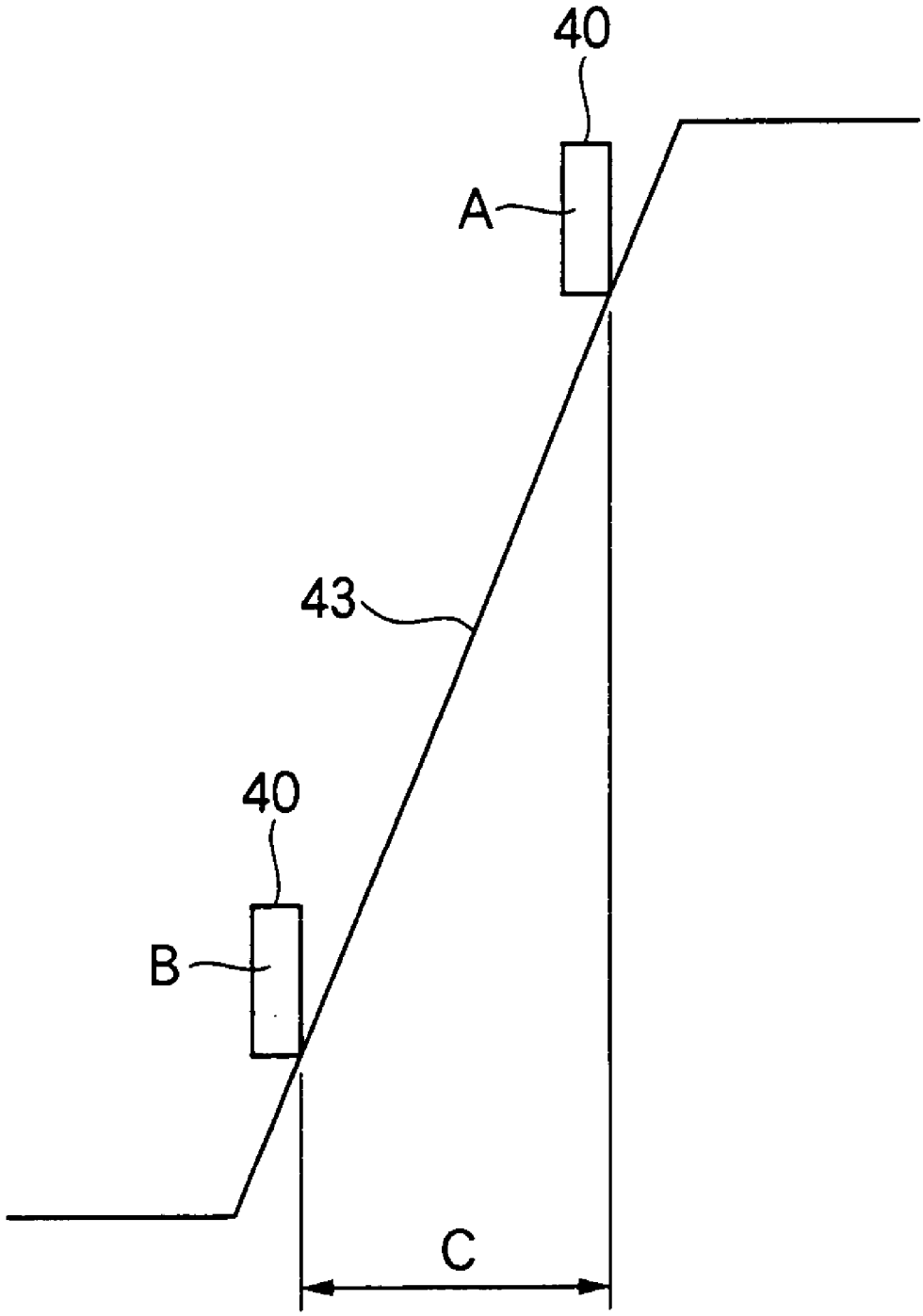
FIG. 18 is an illustrative diagram showing an amount of movement of the toner cartridge.

FIG. 18 is an illustrative diagram showing an amount of movement of the toner cartridge 5.

Referring to FIG. 18, rotating the rotary knob 11 to unlock the toner cartridge 5 causes the projection 40 to move from position A to position B. The distance between position A and position B is the distance c. The distance c is longer than the distance b over which the toner cartridge 5 moves from its locked position until the toner cartridge 5 is no longer under the projections 26*a* and 26*b*.

When the toner cartridge 5 is detached from the receiving section 20, the rotary knob 11 is rotated in a direction shown by an arrow in FIG. 16, i.e., in the opposite direction to that when the toner cartridge 5 is attached. At this moment, the projection 40 slides on the inclined surface 43 downward. At the same time, the toner cartridge 5 moves leftward in FIG. 17 toward the side wall 22. By the time the rotary knob 11 completes its rotation, the toner cartridge 5 has moved by the distance c toward the side wall 22, so that the toner cartridge 5 can be taken out of the receiving section 20 without interfering the projections 26*a* mad 26*b*.

According to the fourth embodiment, the toner cartridge 5 can be taken out from the receiving section 20 without interfering the projections 26*a* and 26*b* without having to employ additional parts but by selecting the shape of the rotary knob 11 and the mounting portion of the toner cartridge 5.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A mounting construction of a toner cartridge that holds toner therein and is attached into an image forming apparatus, the toner cartridge having a rotary member that is rotated about an axis to a position where the toner is discharged into the image forming apparatus, the mounting construction comprising:

a first engagement portion formed on the rotary member, said first engagement portion, extending at an angle with the axis;

a second engagement portion formed on the image forming apparatus;

wherein when said rotary member is rotated in a first direction, said first engagement portion slides on said second engagement portion so that the toner cartridge is displaced in a second direction substantially parallel to the axis.

2. The mounting construction according to claim 1, wherein said first engagement portion is one of two first engagement portions that extend at the angle with the axis and are disposed substantially diametrically opposite to each other with respect to the axis.

3. The mounting construction according to claim 1, wherein said toner cartridge has a stepped portion and the image forming apparatus has a projection, the projection engaging the stepped portion when the toner cartridge is placed in the image forming apparatus.

4. The mounting construction according to claim 1, wherein the image forming apparatus further comprises an urging member that urges the toner cartridge in a third direction opposite to the second direction.

5. The mounting construction according to claim 1, further comprises:

a projection formed on the rotary member;

a third engagement portion formed on the image forming apparatus, said third engagement portion extending at a second angle with the axis;

wherein when the rotary member is rotated in a third direction opposite to the first direction, said projection slides on said third engagement portion so that the toner cartridge is displaced in a fourth direction opposite to the second direction.

6. A toner cartridge that incorporates a mounting construction according to claim 1.

7. An image forming apparatus to which a toner cartridge having a rotary member is attached, wherein the rotary member is rotated about an axis to a position where the toner is discharged into the image forming apparatus, the toner cartridge comprising:

a first engagement portion formed on the rotary member, said first engagement portion extending at an angle with the axis;

the image forming apparatus comprising:

a second engagement portion formed on the image forming apparatus;

wherein when said rotary member is rotated in a first direction, said second engagement portion slides on said first engagement portion so that the toner cartridge is displaced in a second direction substantially parallel to the axis.

* * * * *